US009988188B2

(12) United States Patent
Sasaki

(10) Patent No.: US 9,988,188 B2
(45) Date of Patent: Jun. 5, 2018

(54) METHOD OF PACKING SILICON AND PACKING BODY

(75) Inventor: Go Sasaki, Yokkaichi (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days. days.

(21) Appl. No.: 12/230,141

(22) Filed: Aug. 25, 2008

(65) Prior Publication Data

US 2009/0056279 A1 Mar. 5, 2009

(30) Foreign Application Priority Data

Aug. 27, 2007 (JP) ..... P2007-220221
Jul. 9, 2008 (JP) ..... P2008-179628

(51) Int. Cl.
*B65D 30/08* (2006.01)
*B65D 30/18* (2006.01)
*B65D 81/03* (2006.01)

(52) U.S. Cl.
CPC ..... *B65D 31/04* (2013.01); *B65D 31/08* (2013.01); *B65D 81/03* (2013.01)

(58) Field of Classification Search
CPC .... B65D 33/001; B65D 33/002; B65D 33/18; B65D 33/02; B65D 31/00; B65D 31/10; B65D 31/04; B65D 31/08; B65D 27/00; B65D 81/03; B31B 19/14
USPC ..... 383/37, 123, 120, 109, 111
See application file for complete search history.

(56) References Cited

U.S. PATENT DOCUMENTS 2,080,252 A 5/1937 Cook et al.
3,512,338 A * 5/1970 Nestler ..... 53/390
3,970,241 A * 7/1976 Hanson ..... 383/124
4,648,121 A * 3/1987 Lowe ..... 383/76
4,691,374 A * 9/1987 Watkins et al. ..... 383/104
5,492,410 A 2/1996 Cocozza
5,580,173 A * 12/1996 Sebastian ..... 383/76
5,746,514 A * 5/1998 Orensten ..... 383/66
6,046,443 A * 4/2000 Ackerman et al. ..... 219/727
(Continued)

FOREIGN PATENT DOCUMENTS

EP 0152199 B1 8/1988
GB 2226541 A 7/1990
(Continued)

OTHER PUBLICATIONS

European Search Report dated Jul. 17, 2009 for European Patent Application No. 08162911.5.
(Continued)

*Primary Examiner* — Peter Helvey
(74) *Attorney, Agent, or Firm* — Locke Lord LLP

(57) ABSTRACT

When packing a polycrystalline silicon with a two-layer structured packing body comprising an inner bag (1*a*) and an outer bag (1*b*), there are used the inner bag (1*a*) and the outer bag (1*b*) having bottom sections (4*a*, 4*b*) provided with a pair of tucked sections, the shape of which is substantially a triangle in plan view, formed by inward-folding the portions continued from both of rectangular side face sections (3*a*, 3*b*), and when storing the inner bag (1*a*) that stores the polycrystalline silicon therein into the outer bag (1*b*), the bottom sections (4*a*, 4*b*) are superimposed with the respective tucked sections (6*a*, 6*b*) of the inner bag (1*a*) and the outer bag (1*b*) displaced from each other by 90° so that they do not overlap on each other.

10 Claims, 7 Drawing Sheets

(56) References Cited

U.S. PATENT DOCUMENTS

| | | | | |
|---|---|---|---|---|
| 6,251,154 | B1 | 6/2001 | van Rossen | |
| 2002/0106429 | A1* | 8/2002 | Mudar et al. | 426/129 |
| 2003/0185467 | A1* | 10/2003 | Buchanan | B65D 33/02 383/6 |
| 2003/0228077 | A1* | 12/2003 | Laske | B65D 31/02 383/66 |
| 2004/0234175 | A1* | 11/2004 | Takita | B65D 33/02 383/88 |
| 2005/0252915 | A1* | 11/2005 | Schmidt et al. | 220/88.1 |
| 2006/0257055 | A1* | 11/2006 | Oberdorf | B65D 75/5855 383/94 |
| 2008/0056622 | A1* | 3/2008 | Austreng | B65D 33/1691 383/5 |

FOREIGN PATENT DOCUMENTS

| | | | |
|---|---|---|---|
| JP | H09-240730 | A | 9/1997 |
| JP | 2002-068725 | | 3/2002 |
| JP | 2006-143552 | | 6/2006 |
| KP | 1999-0023348 | | 7/1999 |
| WO | WO-88/09752 | A1 | 12/1988 |

OTHER PUBLICATIONS

First Office Action dated Aug. 18, 2010, for corresponding Chinese Patent Application No. 200810146329.3.

Decision on Grant dated Mar. 14, 2012, issued for the Russian patent application No. 2008134842 and English translation thereof.

Korean Office Action dated May 15, 2014 for corresponding Korean Application No. 10-2008-82119.

Taiwanese Office Action dated Jan. 15, 2013, for corresponding Taiwanese Patent Application No. 097132370.

* cited by examiner

METHOD OF PACKING SILICON AND PACKING BODY

CROSS-REFERENCE TO RELATED APPLICATION

Priority is claimed on Japanese Patent Application No. 2007-220221, filed Aug. 27, 2007, and Japanese Patent Application No. 2008-179628, filed Jul. 9, 2008, the content of which are incorporated herein by reference.

BACKGROUND

Technical Field

The present invention relates to a method of packing silicon and a packing body, the primary packing object of which is polycrystalline silicon used as molten material when manufacturing single crystal silicon.

Related Art

As a method of manufacturing single crystal silicon, there is known the Czochralski method (hereunder, referred to as the CZ method). This CZ method has an advantage in that a large diameter high-purity silicon single crystal in a dislocation-free state or in a state of having very low lattice defects can be easily obtained.

In the CZ method: high-purity polycrystalline silicon is placed in a quartz crucible and melted in a furnace; the silicon melt is contacted with a wire-suspended seed crystal (silicon single crystal); and a silicon single crystal is pulled out gradually while rotating, to grow the silicon single crystal. At this time, in order to increase the volumetric efficiency of the quartz crucible to thereby improve silicon single crystal productivity, lump of polycrystalline silicon which has been cut and crushed from a polycrystalline silicon rod is loaded at high density.

However, since this lump of polycrystalline silicon is a brittle material, the edges of the cut surfaces and the edges of the crushed surfaces are often sharp. Consequently, when this is packed in a packing bag such as a polyethylene resin bag and transported, a cushioning material such as polystyrene foam, bubble cap, or plastic cardboard is used. However, vibrations still cause rubbing between the lump of polycrystalline silicon and the surface of the packing bag, and the lump of polycrystalline silicon and the packing body become pulverized in some cases. If fine powder of such polycrystalline silicon lump and polyethylene resin is brought into the above mentioned quartz crucible together with the lump of polycrystalline silicon, it causes crystal defects in the single crystal silicon produced after being pulled out of the quartz crucible, and consequently causes a reduction in the quality of a silicon single crystal.

Heretofore, in order to avoid such fine powder being generated from the packing bag, for example Patent Document 1 (Japanese Unexamined Patent Application, First Publication No. 2002-68725) proposes a transport method in which lump of polycrystalline silicon is brought into close contact with the packing bag and vacuum-packaged so that the polycrystalline silicon lump and the packing bag do not rub against each other. Moreover Patent Document 2 (Japanese Unexamined Patent Application, First Publication No. 2006-143552) proposes a method of reducing fine powder generated from the packing bag, by managing the area where the lump of polycrystalline silicon and the packing bag can come into contact with each other when packing lump of polycrystalline silicon.

Incidentally, the prime example of a cause of the fine powder generated from the polycrystalline silicon lump and the packing bag is rubbing between the polycrystalline silicon lump and the packing bag caused by vibrations in transport as mentioned above. Therefore, in the case where the methods disclosed in Patent Document 1 and Patent Document 2 are used, since the vibrations received by the polycrystalline silicon lump are not reduced, suppression of fine powder generation is limited. Moreover vibrations can be reduced to a certain degree by inserting a shock absorbing material such as polystyrene foam into the transporting case. However, there is a problem in that in order to reduce vibrations further, use of a large amount of polystyrene foam is necessary, and there is a cost for after-use processing and a negative impact on the environment.

SUMMARY

The present invention takes the above circumstances into consideration, with an object of providing a method of packing silicon and a packing body capable of: suppressing vibrations of silicon mainly such as lump of polycrystalline silicon, with a simple method; further reducing generation of fine powder due to rubbing between the silicon and a packing bag; and avoiding a reduction in the quality of the silicon.

In order to solve the above problems, the present invention proposes the following measures.

An aspect of the present invention provides a multiple-layer structure silicon packing body that uses a plurality of packing bags, wherein each of the packing bags has a bottom section and a plurality of side face sections, said bottom section comprising: a bottom sealed section; and a tucked section above the bottom sealed section, and wherein the bottom sections are superimposed with the respective tucked sections of the packing bags displaced from each other, and wherein the tucked sections of the packing bags are generally disposed over the entire bottom section of packing body.

The tucked section of the bottom section of the packing bag is formed by folding into a multiple-layer structure. Therefore the shock absorbing property is higher than that of other parts. In the aspect of the present invention, when multiple-packing silicon by sequentially overlapping the packing bags, the bottom sections may be superimposed with the tucked sections displaced from each other so as to arrange the tucked sections of any given packing bag on the entire bottom section of the multiple-layer structured packing body. As a result, a high level of shock absorbing property can be attained on the entire bottom section. Consequently impacts and vibrations transmitted to the silicon stored inside can be uniformly distributed and absorbed, and rubbing between the silicon and the packing bag can be prevented. As a result, it is possible to suppress generation of fine powder.

Moreover, even in the case where fine powder of the silicon and the packing bag is generated inside the packing bag, when taking the silicon out of the packing bag, the fine powder is trapped in the folded section of the tucked section and the fine powder is held inside the packing bag, and thereby the fine powder can be effectively removed. Therefore, particularly in the case where the packing object is polycrystalline silicon, it is possible to suppress fine powder from entering a quartz crucible for performing the CZ method, and to maintain the quality of the single crystal silicon to be produced.

Moreover, in the packing body for silicon according to the present invention, the packing bag may have a margin section of an upper end section to form a strip shape by overlapping both opposing side face sections and folding several times, and the strip-shaped folded sections of the respective packing bags may be arranged in different orientations so as to mutually intersect.

Since the strip-shaped folded sections formed on the upper end section of the respective packing bags mutually intersect, a high level of shock absorbing property on the upper end section can be attained, and it is possible to precisely absorb vibrations or impacts from the upper side.

Furthermore, in the packing body for silicon according the present invention, the plurality of packing bags may comprise an inner bag and an outer bag each having a rectangular tube shape, and each of the tucked sections of each of the inner and outer bags may comprise a pair of portions each having a substantially triangle shape in plan view, and the bottom sections may be superimposed with the respective tucked sections of the inner bag and the outer bag displaced from each other by 90° so that they do not overlap on each other.

On the bottom sections of the inner bag and the outer bag, there may be formed a pair of the triangle shaped tucked sections. The tucked section may be formed by superimposing three layers, namely: a layer positioned on the bottom surface of the bottom section; a layer formed with a portion continuing to the side face section being peak-folded inward; and a layer formed with this previous layer being valley-folded inside the tucked section so as to be return-folded. In this case, on the respective bottom sections of the inner bag and the outer bag, the tucked section formed in a triangle shape is of a three-layer structure in which two opposing sides among the four sides that form the outer shape of the bottom section respectively serve as the bases of the triangle shape, and the other portion is of a single-layer section in which the packing bag is single layered. Consequently in the tucked section, the three-layer structured packing bag has a function of a cushion, and the shock absorbing property is greater than that of the single-layer section.

Moreover, when storing the inner bag in the outer bag, the bottom sections may be superimposed with the respective tucked sections displaced from each other by 90° so that they do not overlap on each other, and thereby each of the tucked sections and the single-layer section may overlap on each other in pairs in the bottom section. In this case, on the bottom section of the two-layered bag comprising the inner bag and the outer bag, the three-layer tucked section and the single layer section can form a four-layer structure on the entire bottom section. Consequently a high level of shock absorbing property of the entire bottom section can be attained, and hence impacts and vibrations transmitted to the silicon stored inside can be uniformly distributed and absorbed, and rubbing between the silicon and the packing bag can be suppressed.

Furthermore, in the packing body for silicon according to the present invention, the packing bag may contain a slip agent. Consequently, a packing bag can be smoothly pushed into another packing bag when sequentially storing one packing bag into another. Therefore the operation in forming a multiple layer structure becomes easier, and transmission of external vibrations to the inner-most packing bag can be suppressed, due to the slip of the packing bag. As a result, vibrations transmitted to the silicon stored in the inner-most packing bag can be reduced.

Another aspect of the present invention provides a method of packing silicon with a multiple-layer packing body using a plurality of packing bags, the method comprising: providing each of the packing bags with a bottom section and a plurality of side face sections, said bottom section equipped with a bottom sealed section and a tucked section above the bottom sealed section; and when sequentially overlapping the packing bags to pack silicon, superimposing the bottom sections with the respective tucked sections of the packing bags displaced from each other so that the tucked sections of the packing bags are generally disposed over the entire bottom section of the packing body.

Furthermore, in the method of packing silicon, the plurality of packing bags may comprise an inner bag and an outer bag each having a rectangular tube shape, and each of the tucked sections of each of the inner and outer bags may comprise a pair of portions each having a substantially triangle shape in plan view, and the bottom sections may be superimposed with the respective tucked sections of the inner bag and the outer bag displaced from each other by 90° so that they do not overlap on each other.

According to some aspects of the method of packing silicon and the packing body of the present invention, when packing silicon in a multiple-layer structure, by superimposing the bottom sections with the tucked sections of the respective packing bags displaced from each other, vibrations transmitted to silicon can be suppressed with a simple method, and it is possible to further reduce generation of fine powder generated as a result of rubbing between the silicon and the packing bag, and to reliably avoid a reduction in the quality of the silicon.

DETAILED DESCRIPTION

Figure 1:
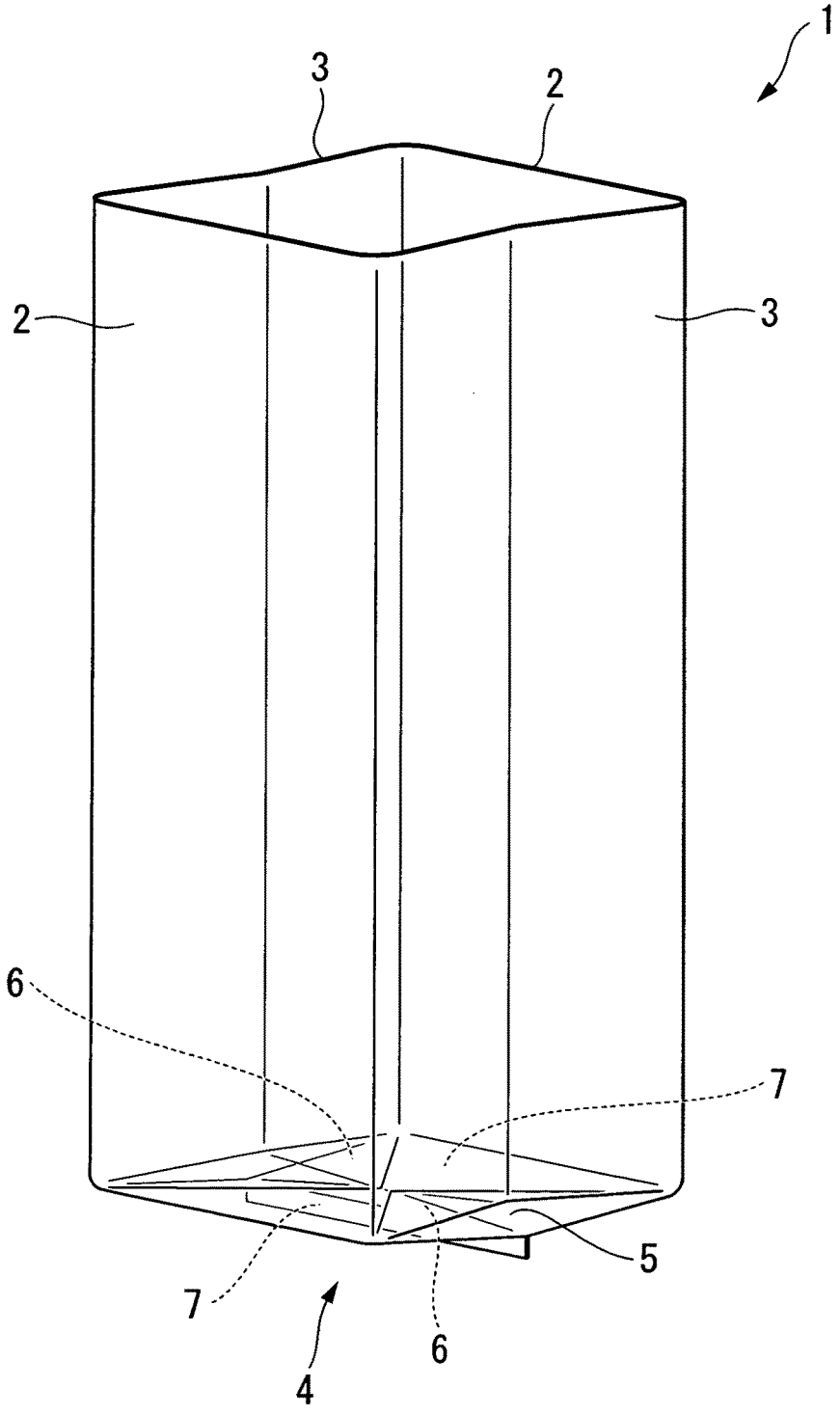
FIG. 1 is a perspective view of a packing bag.

Hereunder, a method of packing silicon and a packing body according to an embodiment of the present invention is described, with reference to the accompanying drawings. FIG. 1 is a perspective view of a packing bag to be used as an inner bag or an outer bag of the present embodiment. A packing bag 1 is formed for example from a transparent film such as polyethylene resin, and has a cross-sectionally substantially square bottomed bag shape with four side face sections 2 and 3 and a bottom section 4. Among the four side face sections 2 and 3, each of a pair of the opposing side face sections 2 has a substantially planar state. In another pair of the opposing side face sections 3, there are provided inward fold lines, which are for valley-folding, along the longitudinal direction to allow the packing bag 1 to be folded into a small size. The packing bag 1 is folded along these fold lines into a small size when not in use, and is expanded into a bag shape when used.

Figure 2:
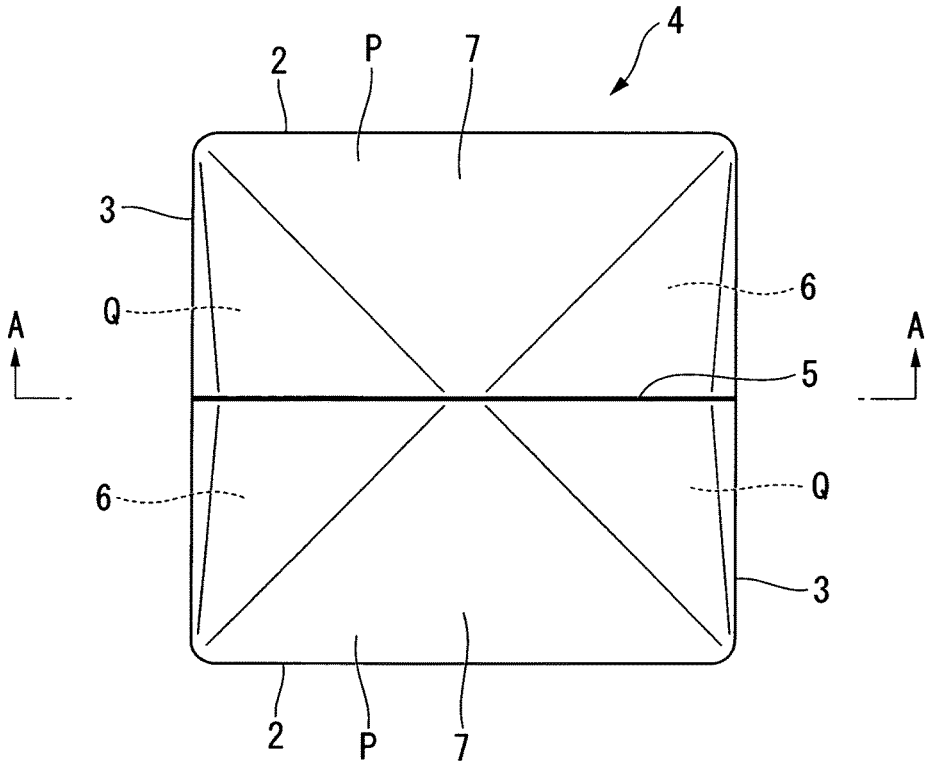
FIG. 2 is a plan view of a bottom section of the packing bag.

In this packing bag 1, the bottom section 4 is formed as described below. First, the side face sections 3 with the fold lines are valley-folded, of the transparent film of a tubular body. On one end of the transparent film, inside faces of end portions of portions P, which are continued from the pair of side face sections 2, are approximated so as to fit together, therefore, between the end portions, the other end portions of portions Q, which are continued from the other pair of side face sections 3 with the fold lines thereon, are intervened in valley-fold state. Then, these end portions are thermally sealed by a sealing device, and a bottom sealed section 5 is thereby formed. Then both of the side face sections 3 having the fold lines thereon are unfold in a planer state, a tubular structure is thereby formed with another pair of side face sections 2. As a result, above the bottom sealed section 5, the portions Q continued from both of the side face sections 3 having the fold lines thereon are tucked inward, and a pair of tucked sections 6 is thereby formed. Thus, in the plan view shown in FIG. 2, each of the tucked sections 6 becomes an isosceles triangle shape, with the respective ridge lines of the bottom section 4 and the side face sections 3 having the fold line thereon, as one side, and the vertex formed substantially in the center of the bottom section 4.

Figure 3:
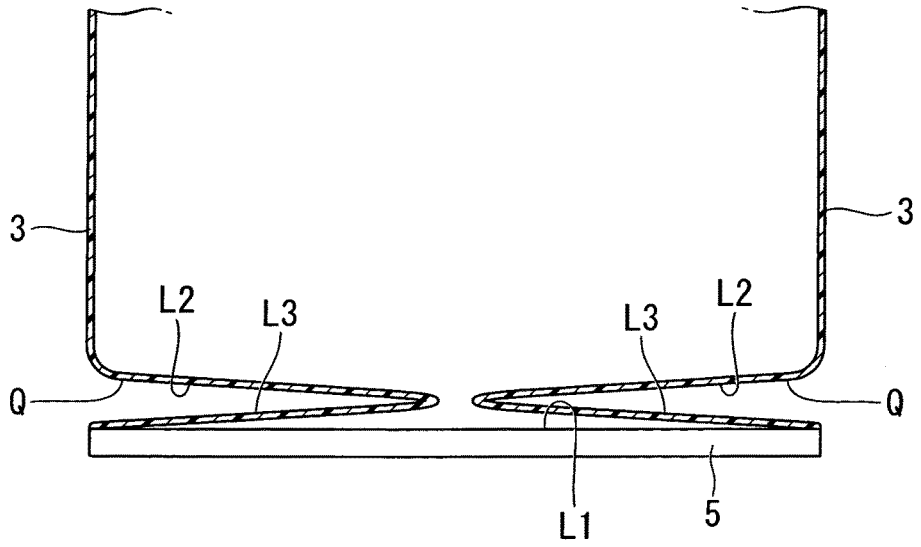
FIG. 3 is a sectional view of the bottom section taken along the A-A line in FIG. 2.

As shown in FIG. 3, each of the tucked sections 6 is formed by superimposing three layers namely: a layer L1 (which is formed by the portions P continued from both of the side face sections 2) positioned on the bottom surface of the bottom section 4 on which the bottom sealed section 5 is provided; a layer L2 formed with each of the inward-peak-folded portions Q continued from the side face sections 3 having the fold lines thereon; and a layer L3 formed by the layer L2 being valley-folded inside the tucked section 6 to fold back. That is to say, on the bottom section 6, each of the isosceles triangle shaped tucked sections 6 in FIG. 2 has a transparent film three-layer structure, and other portions are of a single layered section 7 having a single transparent film layer.

Moreover, in the present embodiment, lump of polycrystalline silicon W which is the raw material for the single crystal silicon, is the primary packing object. This polycrystalline silicon lump W is used as a material in the CZ method which is one of methods for manufacturing single crystal silicon, and can be obtained by cutting and crushing a polycrystalline silicon rod. In the CZ method, single crystal silicon is manufactured by; placing this polycrystalline silicon lump W in a quartz crucible and melting in a furnace, contacting the silicon melt with a wire-suspended seed crystal (silicon single crystal), and pulling out the silicon single crystal gradually while rotating, to grow a silicon single crystal.

Figure 4:
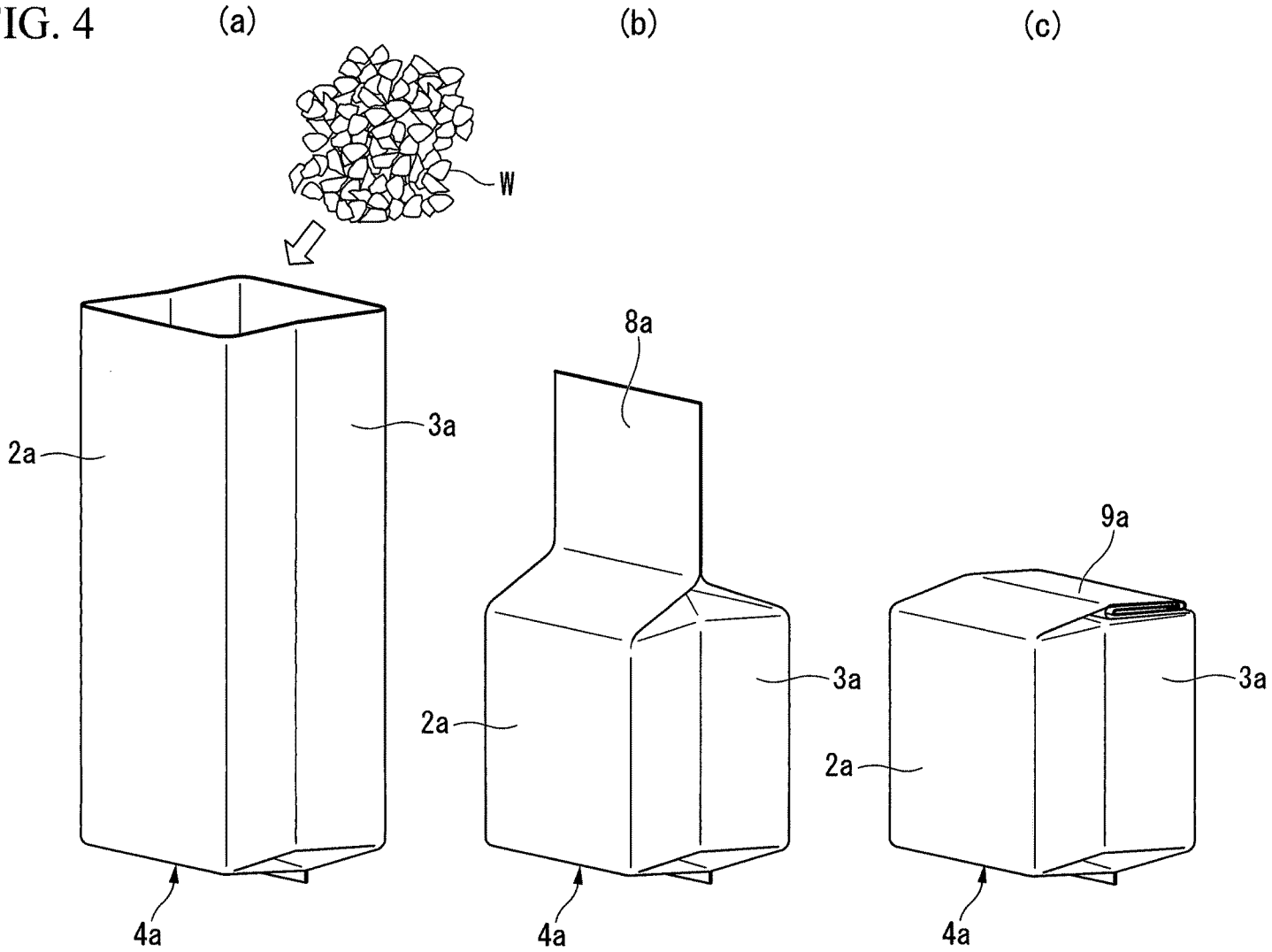
FIG. 4 is a drawing for describing a sequence when storing lump of polycrystalline silicon in an inner bag.

Next, a specific sequence of the silicon packing method is described. With the packing bag 1 formed as described above serving as an inner bag 1*a*, then as shown in part (a) of FIG. 4, at first the polycrystalline silicon lump W is stored in the inner bag 1*a*. Subsequently, as shown in part (b) of FIG. 4, in an opening section on the top end of the inner bag 1*a*, the inside faces of a pair of side faces 2*a* having no fold lines thereon are approximated so as to fit together, therefore, between the end portions of the side faces 2*a*, the other end portions of the side face sections 3*a* with the fold lines thereon, are intervened in valley-fold state. These end portions are overlapped with each other to form a margin section 8*a*, and the margin section 8*a* is sealed. Then, as shown in part (c) of FIG. 4, this margin section 8*a* is folded several times to thereby form a strip-shaped folded section 9*a*, and the sequence of storing the polycrystalline silicon lump W into the inner bag 1*a* is complete.

Figure 5:
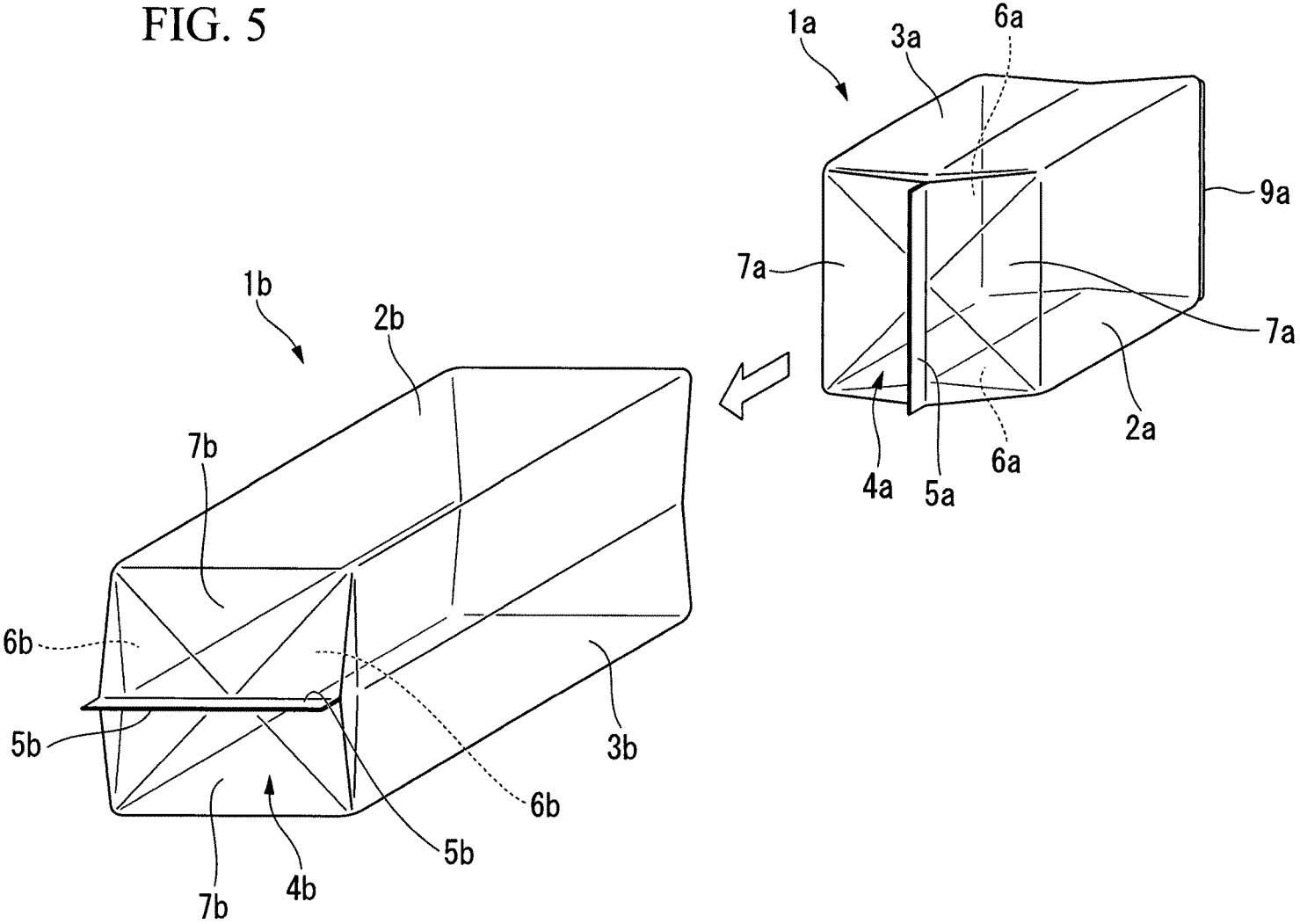
FIG. 5 is an explanatory drawing for describing when storing the inner bag into an outer bag.

Then, as shown in FIG. 5, the inner bag 1*a* having the polycrystalline silicon lump W enclosed therein, is stored into an outer bag 1*b*. The outer bag 1*b* also, as with the inner bag 1*a*, has a shape the same as that of the packing bag 1. However, the outer diameter is slightly greater than that of the inner bag 1*a*. Furthermore, a transparent film which is a constituent material of the outer bag 1*b*, contains a slip material, and as a result the outer bag 1*b* is one in which the surface has a high level of lubricity.

Figure 6:
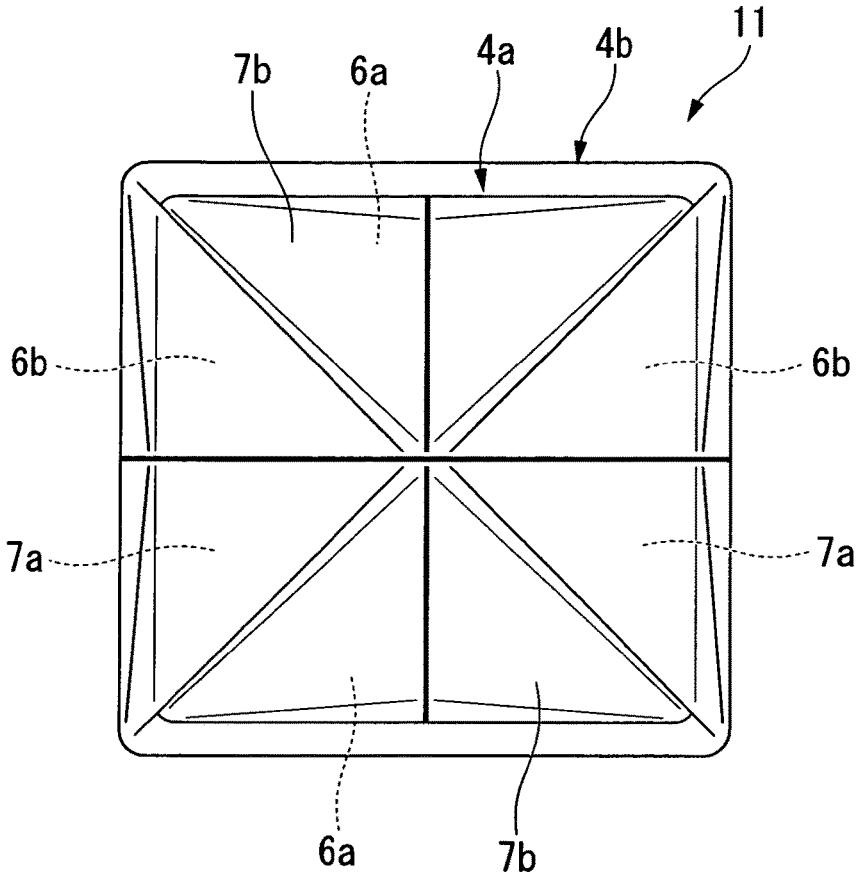
FIG. 6 is a plan view showing the bottom section of a packing body having a two-layer structure comprising the inner bag and the outer bag.

When storing the inner bag 1*a* into the outer bag 1*b*, these are stored so that the sides of the cross-sectional square are aligned. At this time, a bottom section 4*a* of the inner bag 1*a* and a bottom section 4*b* of the outer bag 1*b* are superimposed with the respective tucked sections 6*a* and 6*b* displaced from each other by 90 degrees so that they do not overlap on each other, that is to say, with the side face sections 2*a* of the inner bag 1*a* having no fold lines thereon and the side face sections 3*b* of the outer bag 1*b* having fold lines thereon overlapped on each other, and the side face sections 3*a* of the inner bag having fold lines thereon and the side face sections 2*b* of the outer bag 1*b* having no fold lines thereon overlapped on each other. Consequently, each of the tucked sections 6*a* and 6*b* and each of single layered sections 7*a* and 7*b* in the respective bottom sections 4*a* and 4*b* make a pair and overlap on each other. As shown in FIG. 6, in a bottom section 11 of a two-layer structured packing body 10 comprising the inner bag 1*a* and the outer bag 1*b*, the three-layered tucked sections 6*a* and 6*b* and the single layered sections 7*a* and 7*b* form a four-layered structure of the transparent film in the entire area of the bottom section 11.

Figure 8:
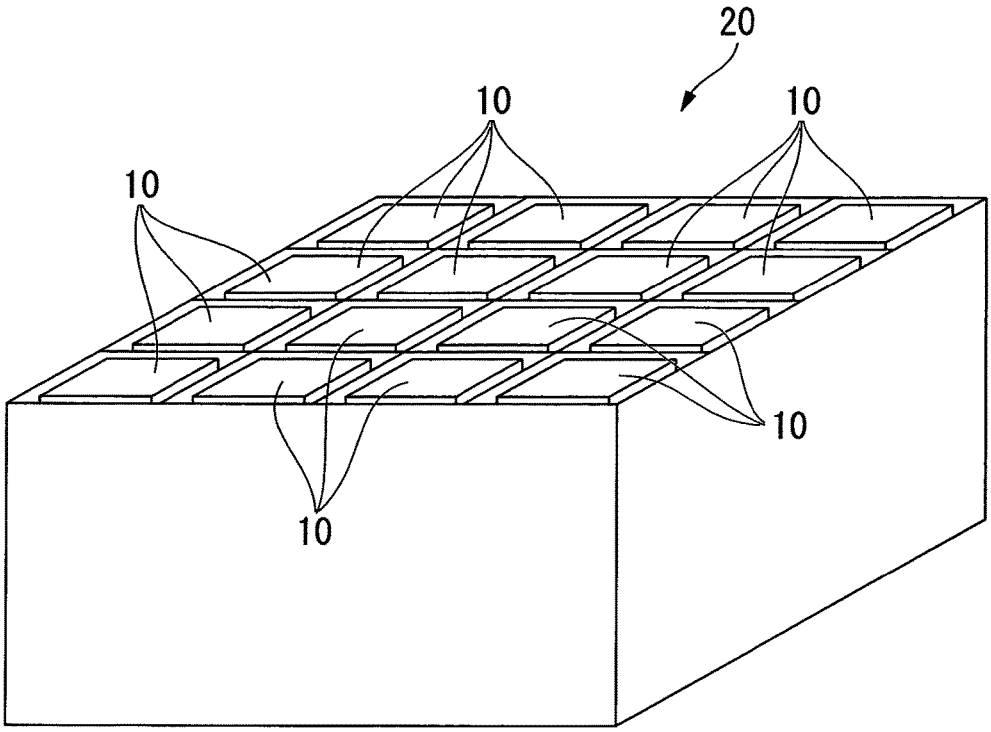
FIG. 8 is a drawing showing a transport case.

The outer bag 1*b* that stores the inner bag 1*a* therein as described above encloses the inner bag 1*a* therein such that, as with the inner bag 1*a*, the pair of side face sections 2*b* having no fold lines thereon are approximated so as to fit together in the opening section on the upper end of the outer bag 1*b*, therefore, between the end portions of the side faces 2*b*, the other end portions of the side face sections 3*b* with the fold lines thereon, are intervened in valley-fold state. These end portions are overlapped with each other so as to form a margin section 8*b* and the margin section 8*b* is sealed. Then a strip shaped folded section 9*b* is formed by further folding this margin section 8*b* several times. Each two-layer structured packing body 10 that internally stores the polycrystalline silicon lump W packed in the above sequence is stored in a transport case 20 shown in FIG. 8 having a number of storage spaces which are further internally layered in a plurality of levels, and is shipped to a single crystal silicon manufacturing factory.

The polycrystalline silicon lump W, which is the packing object of the silicon packing method and the packing body according to the present embodiment, is a brittle material, and hence the edges of the cut surfaces and the edges of the crushed surfaces are often sharp.

Therefore, when transporting in a state of being packed in the packing bag 1 made of polyethylene resin or the like, if vibrations are transmitted to the polycrystalline silicon lump W, the polycrystalline silicon lump W and the surface of the packing bag 1 rub against each other, and the polycrystalline silicon lump W and the packing bag become pulverized. If fine powder of such a polycrystalline silicon lump W and polyethylene resin or the like is brought into a quartz crucible together with the polycrystalline silicon lump W, it causes crystal defects in the single crystal silicon produced after being pulled out of the quartz crucible, and consequently causes a reduction in the quality of the silicon single crystal.

For example, in the case where the polycrystalline silicon lump W is packed in a single packing bag 1, then as for the polycrystalline silicon lump W positioned above the tucked sections 6 of the packing bag 1, each of the tucked sections 6 has a three-layer structure and a high level of shock absorbing property and therefore acts as a cushion so as to absorb vibrations that occur in transport. As a result it is possible to suppress rubbing between the polycrystalline silicon lump W positioned above the tucked sections 6 and the packing bag 1, and hence pulverization of the polycrystalline silicon lump W and the packing bag 1 is suppressed. However, for the polycrystalline silicon lump W positioned above the single layered section 7, since the vibrations are directly transmitted thereto, the polycrystalline silicon lump W and the packing bag 1 rub against each other, and fine powder of the polycrystalline silicon lump W or the packing bag 1 is generated. This powder emerges on the bottom section 4, as contamination that only occurs at the area of the single layered section 7.

On the other hand, in the present embodiment, as described above, by superimposing the bottom sections 4*a* and 4*b* with the respective tucked sections 6*a* and 6*b* of the inner bag 1*a* and the outer bag 1*b* displaced by 90° so that they do not overlap on each other, it is possible to form, on the entire bottom section 11 of the two-layer structured packing body 10 comprising the inner bag 1*a* and the outer bag 1*b*, a four-layered structure of the transparent film from the three-layered tucked sections 6*a* and 6*b* and the single layered sections 7*a* and 7*b*.

In other words, in the embodiment, the packing body 10 is a multiple-layer packing body for silicon that comprises: a plurality of packing bags (sheet bags) 1*a*, 1*b* respectively having bottom sections 4*a*, 4*b* being superimposed on each other, at least one sheet stack section (i.e., the tucked sections 6*a*, 6*b*) being partially provided at each of the bottom sections 4*a*, 4*b*, wherein the sheet stack sections (6*a*) of one of the packing bags 1*a*, 1*b* are displaced from the sheet stack sections (6*b*) of another one of the packing bags (1*a*, 1*b*). The sheet stack sections (i.e., the tucked sections 6*a*, 6*b*) of the packing bags 1*a*, 1*b* are generally disposed over (or cover) the entire bottom section 11 of packing body 10.

In the present embodiment, the sheet stack sections (6*a*) of one of the packing bags 1*a*, 1*b* are shifted from the sheet stack sections (6*b*) of another one of the packing bags 1*a*, 1*b* about a point. Alternatively or also, the sheet stack section(s) of one of the packing bags may shift from the sheet stack section(s) of another one of the packing bags along a line. In the present embodiment, the total number of stacked sheets is substantially the same over the substantially entire area of the superimposed bottom section 4*a*, 4*b*. In the present embodiment, each of the bottom sections 4*a*, 4*b* comprises: a first region (6*a*, 6*b*) in which at least one of the sheet stack section is formed; and a second region (7*a*, 7*b*) in which no sheet stack section (or sheet stack section with less stacked sheets) is formed, and the first region (6*a*, 6*b*) of one of the packing bags 1*a*, 1*b* is superimposed on the second region (7*b*, 7*a*) of another one of the packing bags 1*a*, 1*b*. The first region (6*a*, 6*b*) has a similar shape to the second region (7*a*, 7*b*). Both the first region (6*a*, 6*b*) and the second region (7*a*, 7*b*) comprise substantially polygonal shapes (triangle shapes). The first region (6*a*, 6*b*) has a nearly equal size as the second region (7*a*, 7*b*), or the first region (6*a*, 6*b*) has a small size than the size of the second region (7*a*, 7*b*). Each of the bottom sections 4*a*, 4*b* comprises a plurality of the first regions (6*a*, 6*b*) and a plurality of the second regions (7*a*, 7*b*), and the first regions (6*a*, 6*b*) and the second regions (7*a*, 7*b*) are alternately disposed in the circumferential direction about a point. Each of the bottom sections 4*a*, 4*b* has a substantially polygonal shape, and one of the first regions (6*a*, 6*b*) or one of the second regions (7*a*, 7*b*) is arranged corresponding to each one side of the polygonal shape of each of the bottom sections 4*a*, 4*b*. In the present embodiment, the sheet stack sections (6*a*, 6*b*) can comprise a gusset section of the packing body 1*a*, 1*b*.

As a result a high level of shock absorbing property can be given to the entire bottom section 11. Therefore it is possible to disperse and absorb impacts and vibrations transmitted to the internally stored polycrystalline silicon lump W, and rubbing between the polycrystalline silicon lump W and the inner bag 1*a* can be suppressed. Consequently it is possible to further reduce the occurrence of fine powder from the polycrystalline silicon lump W and the inner bag 1*a*, and to prevent a reduction in the quality of the polycrystalline silicon lump W.

Moreover, with use of the previously utilized packing bag 1, it is possible with such a simple method described above, to reliably suppress vibrations received by the polycrystalline silicon lump W. Therefore, without the special need for an additional facility, it is possible to easily avoid a reduction in the quality of the polycrystalline silicon lump W. Furthermore, in transport, it is possible to suppress vibrations without use of an excessive amount of polystyrene foam (expanded polystyrene) as a shock absorbing material, and therefore there is no cost for processing polystyrene foam, and no negative impact on the environment.

Furthermore, even in the case where fine powder of the polycrystalline silicon lump W and the inner bag 1*a* is generated inside the inner bag 1*a*, when taking the polycrystalline silicon lump W out of the inner bag 1*a*, the fine powder is trapped in the folded section of the tucked section 6*a* and the fine powder is held inside the inner bag 1*a*, and thereby the fine powder can be effectively removed. Therefore, it is possible to suppress the fine powder entering the quartz crucible for performing the CZ method, and to maintain the quality of the single crystal silicon to be produced.

Figure 7:
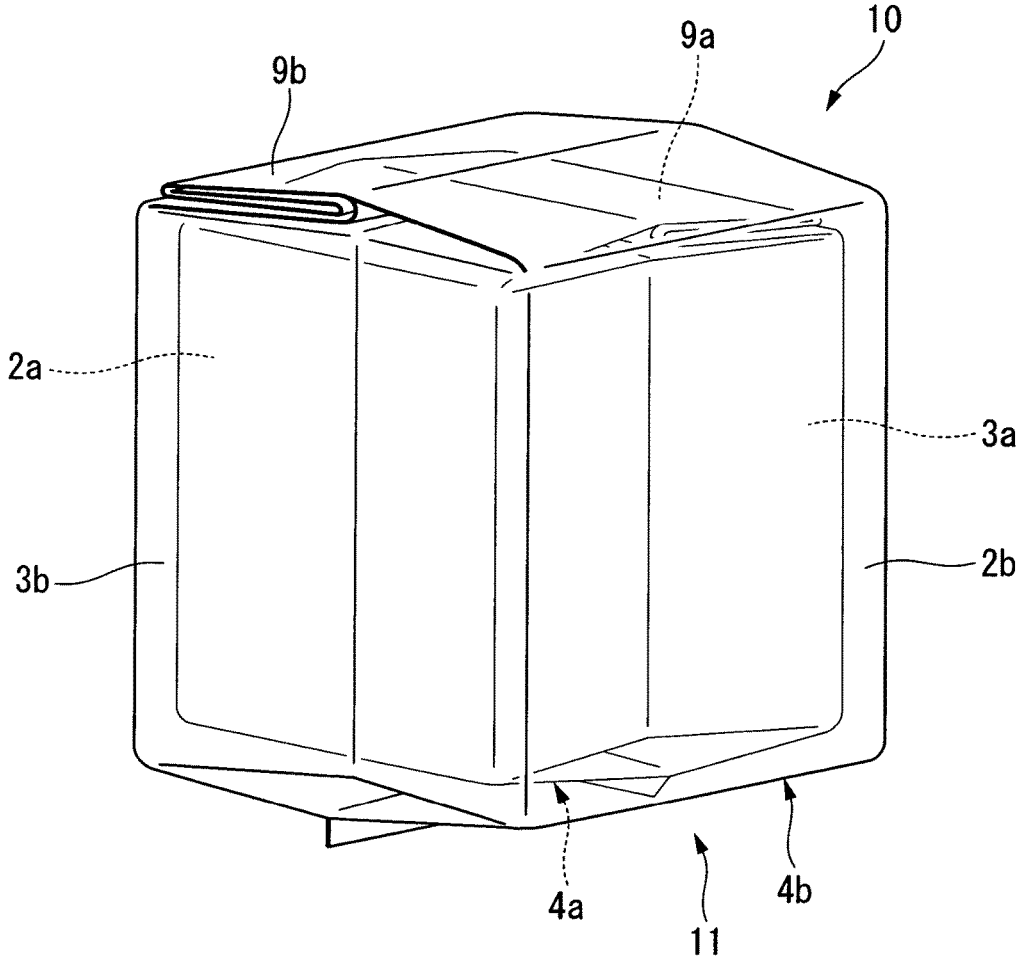
FIG. 7 is a perspective view of the packing body having the two-layer structure with the inner bag and the outer bag.

Moreover, in the present embodiment, in the case of packing the polycrystalline silicon lump W with the two-layer structured packing body 10 comprising the inner bag 1*a* and the outer bag 1*b*, then as shown in FIG. 7, the respective folded sections 9*a* and 9*b* on the upper end section of both bags 1*a* and 1*b* intersect with each other at a 90° angle. Therefore, a high level of shock absorbing property on the upper end section can be attained, and it is possible to desirably absorb vibrations or impacts from the upper side.

Furthermore, as described above, the outer bag 1*b* of the packing bag 1 for polycrystalline silicon according to the present invention contains a slip agent. Therefore it is possible to smoothly push the inner bag 1*a* into the outer bag 1*b* and thus facilitate the operation during two-layer packing. Moreover, when external vibrations are transmitted to the outer bag, the surface of the inner bag 1*a* and the inside face of the outer bag 1*b* slip on each other, so that even if the outer bag 1*b* vibrates, it is possible to reduce transmission of these vibrations to the inner bag 1*a*. As a result it is possible to further reduce vibrations transmitted to the polycrystalline silicon lump W, and generation of the fine powder can be further effectively suppressed.

In order to confirm the effectiveness of the packing bag according to the present embodiment, a transportation test was conducted. In this test, five hundred first packing bags and five hundred second packing bags were provided and were packed in corrugated boxes. Lump of polycrystalline silicon, which was packed in each one of the first and second packing bags, has a length of 5-60 mm and has a total weight of 5 kg lump. In each of the first packing bags, the tucked section of the inner bag was superimposed with the tucked section of the outer bag. In each of the second packing bags, the tucked sections of the inner bag and the outer bag were displaced from each other by 90° so that they do not overlap on each other. A truck on which the corrugated boxes were loaded runs 500 km, for reproducing the vibration in transport condition. After the running, in the first packing bags (the tucked sections of the inner bag and the outer bag were superimposed with each other), the controversial powder on the bottom section was substantially confirmed. On the contrary, in the second packing bags (the tucked sections of the inner bag and the outer bag were displaced from each other), the adherence fine powder on the bottom section was not confirmed.

The method of packing silicon and the packing body that are an embodiment of the present invention have been described. However, the present invention is not to be considered limited to this embodiment, and may be appropriately modified without departing from the technical scope of the invention. For example, in the present embodiment, for each of the inner bag 1*a* and the outer bag 1*b*, the margin sections 8*a* and 8*b* are formed by overlapping the side face sections 2*a* and 2*b* having no fold lines thereon on each other, and these margin sections are folded several times to form the folded sections 9*a* and 9*b*. However, the margin sections may be formed by overlapping the side face sections 3*a* and 3*b* having the fold lines thereon on each other, and the folded sections may thereby be formed.

In the present embodiment, there has been described a case where the polycrystalline silicon lump W is packed in a two-layer structure. However, it is not limited to this, and may be packed in a structure of three or more layers. Moreover, the shape of the packing bag 1 is not limited to the shape of the present embodiment, as long as there are formed tucked sections. That is to say, with any shape of the packing bag, the intent of the present invention is to displace and superimpose the bottom sections of the respective packing bags, and arrange the tucked sections in the entire area of the bottom section of the packing body, and includes any embodiment as long as this intent is satisfied.

Furthermore, in the present embodiment, the polycrystalline silicon lump W is taken as the object of packing. However, the object of packing is not limited to this, and for example, even in the case of packing cut-rods cut from a polycrystalline silicon rod or packing single crystal silicon, the present method of packing silicon and the packing body can be applied.

What is claimed is:

1. A multiple-layer packing body for silicon consisting of: a plurality of packing bags consisting of an inner bag and an outer bag, the inner bag being superposed in the outer bag, wherein each packing bag is made of:
- a substantially square bottom section;
- a bottom sealed section; and
- four side face sections, each bottom section is made of:
- tucked sections each consisting of three sheets each having a substantially isosceles triangle shape in plan view; and
- non-tucked sections between the tucked sections each consisting of a sheet each having a substantially isosceles triangle shape in plan view, the tucked sections of one of the plurality of packing bags and the non-tucked sections of the other packing bag are stacked and constitute an entire bottom section of the packing body with four sheets, each packing bag has a margin section of an upper end section to form a strip shape by overlapping both opposing side face sections and folding several times, the strip-shaped folded sections of the respective packing bags are arranged in parallel to the bottom sealed section, and a top section of the packing body is configured to include:
- a first region including the strip-shaped folded section of the inner bag;
- a second region including the strip-shaped folded section of the outer bag which longitudinal direction of the strip shape is orthogonally arranged to a longitudinal direction of the strip shape of the strip-shaped folded section of the inner bag; and
- a third region where the strip-shaped folded sections of the respective packing bags are overlapped on each other.

2. A method of packing silicon with a multiple-layer packing body using a plurality of packing bags, said method comprising:

providing a multiple-layer packing body for silicon consisting of: a plurality of packing bags consisting of an inner bag and an outer bag, the inner bag being superposed in the outer bag, wherein each packing bag is made of:
- a substantially square bottom section;
- a bottom sealed section; and
- four side face sections, each bottom section is made of:
- tucked sections each consisting of three sheets each having a substantially isosceles triangle shape in plan view; and
- non-tucked sections between the tucked sections each consisting of a sheet each having a substantially isosceles triangle shape in plan view, where the tucked sections of one of the plurality of packing bags and the non-tucked sections of the other packing bag are stacked and constitute an entire bottom section of the packing body with four sheets, each packing bag has a margin section of an upper end section to form a plate shape by overlapping both opposing side face sections and folding several times, the strip-shaped folded sections of the respective packing bags are arranged in parallel to the bottom sealed section, and a top section of the packing body is configured to include:
- a first region including the strip-shaped folded section of the inner bag;
- a second region including the strip-shaped folded section of the outer bag; and
- a third region where the strip-shaped folded sections of the respective packing bags are overlapped on each other; and packing silicon in the inner bag of the plurality of packing bags, whereby a high level of shock absorbing property can be attained on the entire bottom section, impacts and vibrations transmitted to the silicon stored inside can be uniformly distributed and absorbed, rubbing between the silicon and the packing bag can be prevented, and the generation of fine powder can be suppressed.

3. The method of packing silicon according claim 2, wherein the inner bag and the outer bag are superimposed and displaced from each other by 90°.

4. A multiple-layer packing body for silicon consisting of: a plurality of transparent packing bags consisting of an inner bag and an outer bag, the inner bag being superposed in the outer bag, wherein each packing bag is made of:

a substantially square bottom section;

a bottom sealed section;

a margin section at an upper end; and four side face sections, each bottom section is made of:

tucked sections each consisting of three sheets each having a substantially isosceles triangle shape in plan view; and non-tucked sections between the tucked sections each consisting of a sheet each having a substantially isosceles triangle shape in plan view, the tucked sections of one of the plurality of packing bags and the non-tucked sections of the other packing bag are stacked and constitute an entire bottom section of the packing body with four sheets, each margin section forms a strip-shaped folded section by overlapping both opposing side face sections and folding several times, a longitudinal direction of the strip-shaped folded section of the outer bag is orthogonally arranged to that of the inner bag, and the strip-shaped folded sections of the respective packing bags are overlapped on each other in parallel to the bottom sealed section.

5. The multiple-layer packing body according claim 1, wherein an outer diameter of the outer bag is slightly greater than that of the inner bag.

6. The multiple-layer packing body according claim 1, wherein a constituent material of the outer bag contains a slip material.

7. The multiple-layer packing body according claim 1, wherein respective tucked sections of the inner bag and the outer bag are superimposed and displaced from each other by 90°.

8. The multiple-layer packing body according claim 1, wherein with the side face sections of the inner bag having no fold lines thereon and the side face sections of the outer bag having fold lines thereon overlapped on each other, and the side face sections of the inner bag having fold lines thereon and the side face sections of the outer bag having no fold lines thereon overlapped on each other, whereby each tucked section and each non-tucked section in the respective bottom sections make a pair and overlap on each other.

9. The multiple-layer packing body according claim 1, wherein each packing body that internally stores polycrystalline silicon lump is stored in a transport case having a number of storage spaces which are further internally layered in a plurality of levels.

10. The multiple-layer packing body according claim 1, wherein a fine powder is trapped in a folded part of the tucked section and the fine powder is held inside the inner bag, thereby the fine powder can be effectively removed.

* * * * *